US007527523B2

(12) United States Patent
Yohn et al.

(10) Patent No.: US 7,527,523 B2
(45) Date of Patent: May 5, 2009

(54) HIGH POWER TERMINAL BLOCK ASSEMBLY

(75) Inventors: Brent David Yohn, Newport, PA (US); Robert Charles Flaig, Lancaster, PA (US); Lawrence Se-Jun Oh, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/743,248

(22) Filed: May 2, 2007

(65) Prior Publication Data

US 2008/0274645 A1 Nov. 6, 2008

(51) Int. Cl.
*H01R 13/73* (2006.01)

(52) U.S. Cl. ..... 439/564

(58) Field of Classification Search ..... 439/595, 439/762, 772, 765, 770, 754, 76.1, 564, 722, 439/500, 108, 709
See application file for complete search history.

(56) References Cited

U.S. PATENT DOCUMENTS 4,343,529 A * 8/1982 Reavis et al. ..... 439/406
4,345,806 A 8/1982 McHenney
5,088,941 A * 2/1992 Nolle ..... 439/762
5,173,060 A 12/1992 Shimirak et al.
5,203,724 A 4/1993 Casey
5,219,302 A 6/1993 Robertson et al.
5,839,924 A * 11/1998 Ritson ..... 439/757
6,176,710 B1 * 1/2001 Ewing et al. ..... 439/76.1
7,097,502 B2 8/2006 Landis et al.
2005/0042918 A1 * 2/2005 Jensen et al. ..... 439/571

FOREIGN PATENT DOCUMENTS

GB 1 390 681 4/1975
GB 1 585 312 2/1981

* cited by examiner

*Primary Examiner*—Edwin A. Leon

(57) ABSTRACT

A power terminal and a method for making a power terminal having an electrically insulated connector body. A terminal insert is incorporated into the connector body and has at least one threaded electrically conductive member engaged with the terminal insert. The conductive member also includes a cap portion. The terminal insert is formed from a substantially rigid material and is configured to resist torque and pull out forces provided to the conductive member.

20 Claims, 7 Drawing Sheets

HIGH POWER TERMINAL BLOCK ASSEMBLY

FIELD OF THE INVENTION

The present invention is directed to electrical connectors. In particular, the present invention is directed to corrosion resistant electrical power terminal assemblies resistant to torque, resistant to pull out force applied to the terminals.

BACKGROUND OF THE INVENTION

A wide variety of power terminal assemblies exist for use today, depending upon the environment and application for which it is intended. In some applications, multiple sets of wires within an end product are joined within the power terminal assembly to external power cords and other types of wire. Examples of this application may be found in various environments, such as in aircraft electrical and power systems or in manufacturing where equipment is utilized having high power demands.

Further, conventional power terminal assemblies may be difficult to manufacture and may potentially become damaged or disassembled over time. In general, conventional power terminal assemblies include a housing formed of an insulative material and shaped to provide one or more regions therein to receive conductive power terminal connectors. Each power terminal connector is configured to join a power line from the end product (e.g., an electrical device) and a corresponding power cord from the power source. Each power terminal connector is held within the insulated housing of the power terminal assembly through a separate fastening means, such as rivets, bolts, screws, and similar electrical connection devices. Over the life of the power terminal assembly, the terminals within the power terminal may become loose or disconnected. In particular, some power terminal applications require a large torque force on the terminals to sufficiently secure the electrical connection. These large torque forces may result in failure of the power terminal by fracture of the housing at the mounting points and/or breakage or unintentional disengagement of the terminals from the power terminal. In addition, the power terminal are subject to a variety of pull out forces that act to disengage the terminals from the terminal block. Further still, power terminals may be subject to harsh or oxidative atmospheres that degrade the materials of the power terminal and thereby render the power terminal susceptible to damage or breakage.

What is needed is a power terminal and housing having resistance to torque, pull out forces and environment conditions and permitting the securing of the terminals with sufficient retaining force to prevent unintentional disengagement of the electrical connections thereto.

SUMMARY OF THE INVENTION

One aspect of the invention includes a power terminal having an electrically insulated connector body. A terminal insert is incorporated into the connector body and has at least one threaded electrically conductive member engaged with the terminal insert. The conductive member also includes a cap portion. The terminal insert is formed from a substantially rigid material and is configured to resist torque and pull out forces applied to the conductive member.

Another aspect of the present invention is a method for forming a power terminal. The method includes providing a substantially rigid terminal insert having a threaded conductive member engaged thereto. The terminal insert is incorporated into a connector body. The terminal insert is configured to resist torque and pull out forces applied to the conductive member.

An advantage of an embodiment of the present invention is that the terminal insert is easily fabricated and provides mechanical properties desired for the terminal block, including resistance to torque.

Another advantage of an embodiment of the present invention is that the mounting bar is easily fabricated and provides mechanical properties desired for the terminal block, including providing rigidity and stability to the connector body.

Still another advantage of an embodiment of the present invention is that the conductive members may be sufficiently engaged to the connector body via the terminal insert such that rotation of the conductive member is substantially prevented, even under high torque, such as, but not limited to torque of 240 lb.-in. or more.

Still another advantage of an embodiment of the present invention is that the conductive members may be sufficiently engaged to the connector body via the terminal insert such that the terminals and terminal insert remain sufficiently engaged to resist high pull out forces, including forces on the electrical connections resulting from operation of a moving vehicle.

Still another advantage of an embodiment of the present invention is that the power terminal is resistant to environmental conditions and is resistant to corrosion and other degradation resulting from harsh or oxidative atmospheres.

Still another advantage of an embodiment of the present invention is that the power terminal is resistant to repeated cycles of engagement of wires to the conductive members, while retaining the resistance to torque, damage breakage and/or fatigue.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
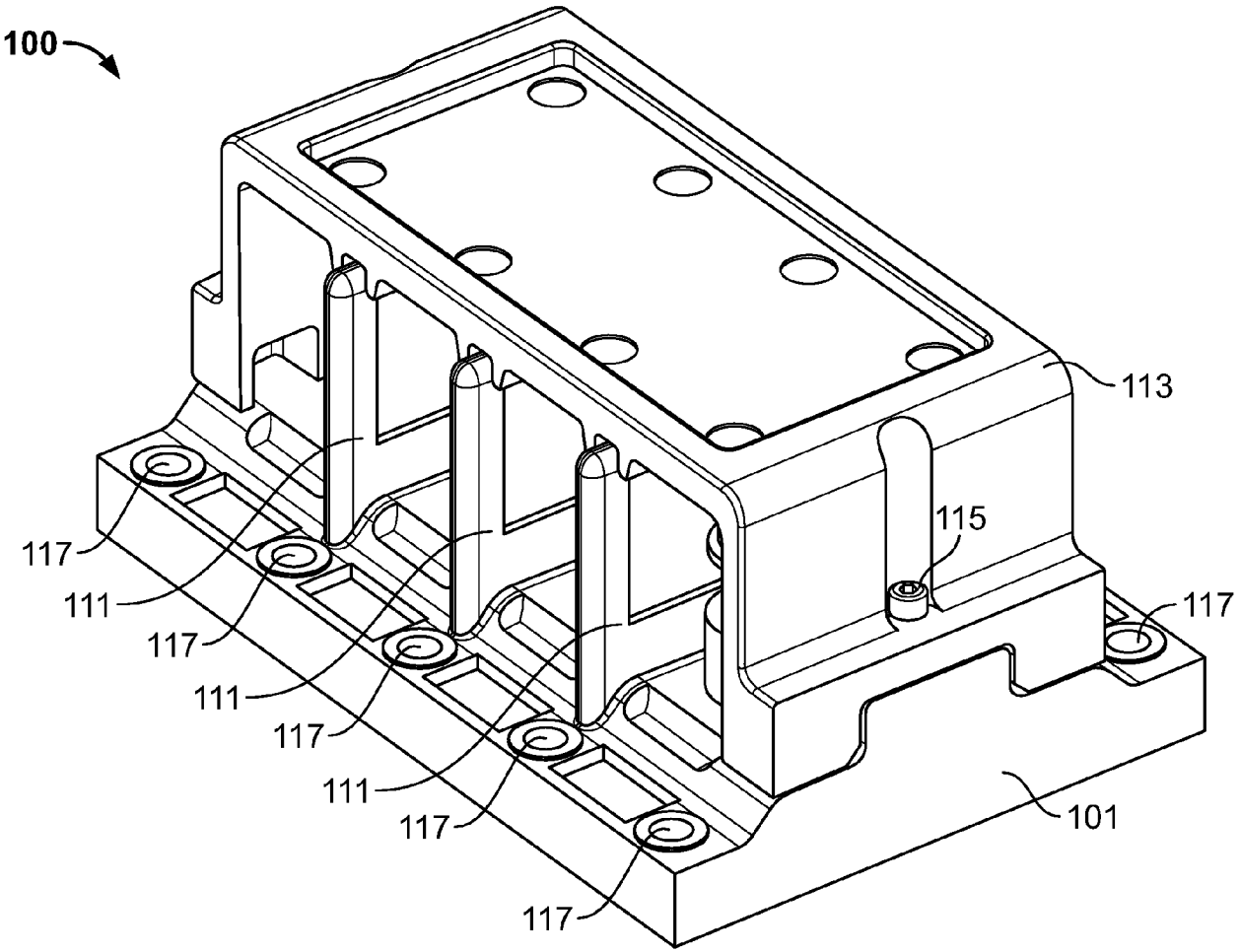
FIG. 1 illustrates a power terminal according to an embodiment of the present invention.
Figure 2:
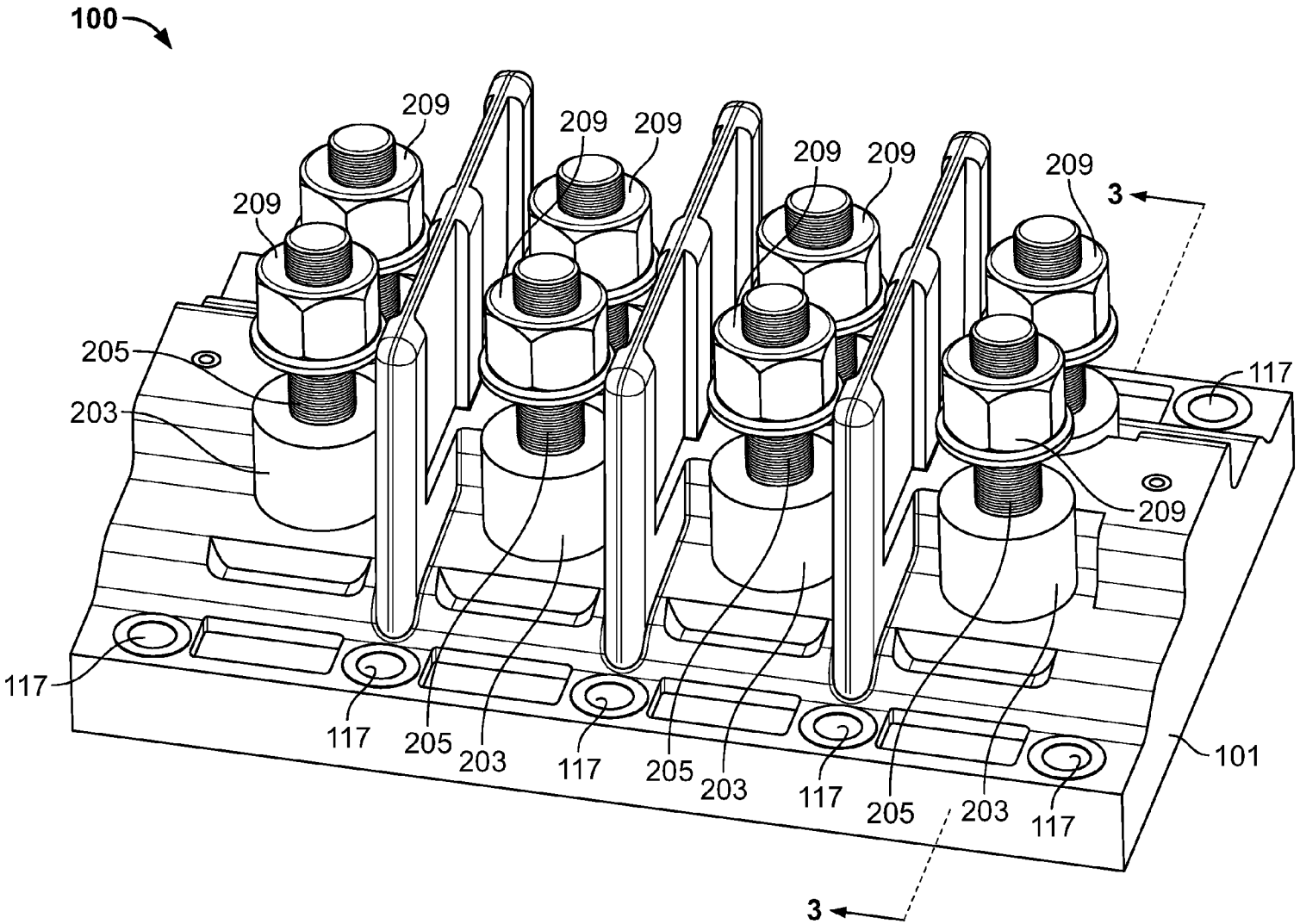
FIG. 2 illustrates a power terminal according to an embodiment of the present invention with the cover removed.

With respect to FIGS. 1-2, FIG. 1 illustrates a power terminal 100 according to an embodiment of the present invention having a cover 113. FIG. 2 illustrates a power terminal 100 according to an embodiment of the present invention having the cover 113 removed. Power terminal 100 includes a connector body 101 formed from an electrically insulative material. Suitable materials for forming the connector body 101 include formable polymers, such as, but not limited to composite thermal plastics, epoxy, phenolic, and/or polyester resins. One suitable material includes, but is not limited to polyphenylene sulfide (PPS).

As shown in FIG. 1, power terminal 100 also includes mounting openings 117 preferably arranged along a peripheral edge of the connector body 101. The mounting openings 117 may include machined openings or formed openings configured to receive a fastener. The configuration of mounting openings 117 may be any geometry that provides the capability of fastening the terminal block in a location having the desired accessibility to wires 901 (see e.g., FIG. 9) or other electrical devices requiring connectivity.

As shown in FIG. 1, the power terminal 100 preferably further includes a cover 113 fabricated from an electrically insulative material, such as a thermoplastic or other polymer. The cover 113 is preferably sufficiently rigid to prevent unintentional damage, when the power terminal 100 is connected to wires or other electrical devices. In addition, cover 113 preferably provides protection against electrical shock, shorting or arcing when power is applied to the power terminal 100. Cover 113 is preferably attached to the connector body 101 by cover mount 115, which includes any suitable fastening arrangement, such as a screwing or bolting arrangement. For example, connector body 101 may have tapped threading features or a threaded insert to accept a fastener cover mount 115.

The connector body 101 includes terminal inserts 203 (FIG. 2) incorporated into the connector body 101. By "incorporated", it is meant that a component such as the terminal inserts 203 and/or the mounting bar 307 (see e.g., FIG. 3), having been formed as separate components, are provided during the formation of the connector body 101 and are positioned at least partially within the connector body 101, where at least a portion of the component is enveloped sufficiently to retain the component in position within the connector body 101 of power terminal 100. For example, incorporation may include overmolding the terminal insert 203 with a thermoplastic or similar polymeric material forming the connector body 101. The terminal inserts 203 may be formed utilizing any suitable technique, including machining, casting, or any other known fabrication technique. The terminal inserts 203 are configured to receive an electrically conductive member 205 forming the terminal, the conductive member 205, useful for connecting to wires or other electrical devices.

Figure 3:
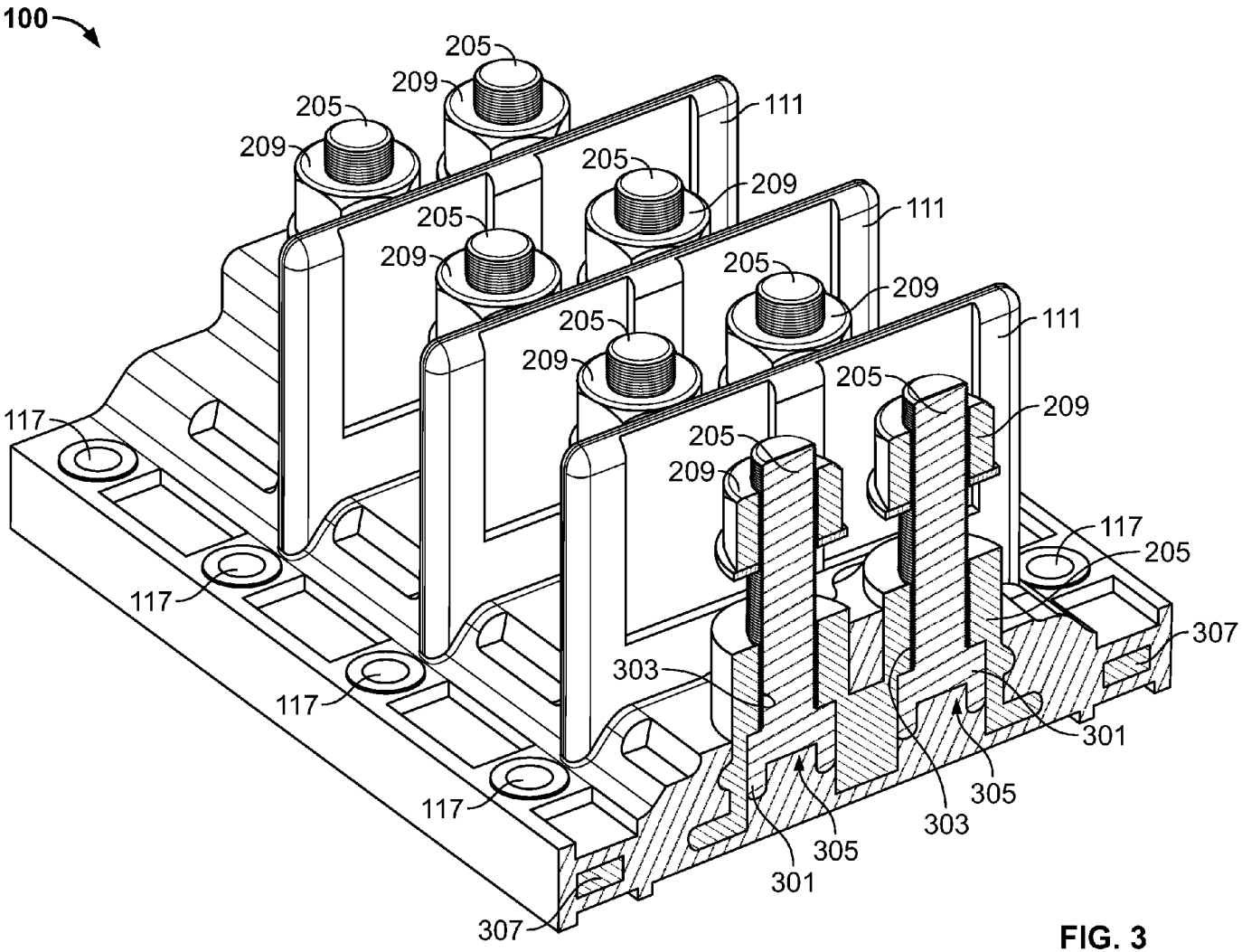
FIG. 3 shows a top perspective view including a cross-section taken along line 3-3 of FIG. 2 of a power terminal according to an embodiment of the present invention.

The conductive members 205 are preferably composed of a metallic material, such as, but not limited to stainless steel. Terminal inserts 203 preferably having openings 303 forming surfaces that are mechanically threaded with a helical ridge or other suitable material feature, capable of engagement with the electrically conductive member 205 (see e.g., FIG. 3). As shown in FIG. 2, correspondingly threaded electrically conductive members 205 are engaged with terminal inserts 203, which are likewise incorporated into the connector body 101 (see also, FIG. 3, showing the terminal insert 203 incorporated into the connector body 101). The threading parameters of the terminal insert 203 and the electrically conductive member 205 are not particularly limited and may include any suitable pitch, diameter or geometry. The electrically conductive member 205 may be a bolt, rivet, screw or similar screw-like configuration, wherein the conductive member 205 includes a head or cap 301 (see e.g., FIG. 3). The configuration of the cap 301 may include any suitable cap 301 geometry for use with the terminal insert 203 and/or any geometry suitable for engaging surfaces of the terminal insert 203 to substantially prevent rotation, such as, but not limited to, a pan head geometry, button or dome head geometry, round head geometry, truss head geometry, flat head geometry, oval head geometry, hex or socket head geometry, or any other suitable cap geometry.

The power terminal 100 according to the present invention is preferably resistant to environmental conditions and is resistant to corrosion and other degradation resulting from harsh or oxidative atmospheres. In order to render the power terminal 100 corrosion and environmentally resistant, one or both of the terminal insert 203 and the conductive member 205 may be fabricated from or coated with a corrosion resistant material. For example, the terminal insert 203 and/or the conductive member 205 having an electroless nickel surface may be coated with a chromate coating. In another embodiment, a dual nickel surface having of combination of electrolytic nickel and electroless nickel may be coating with a chromate coating. In still another embodiment, an electroless nickel surface may be coated with an electroless nickel. In yet another embodiment, the terminal insert 203 and/or the conductive member 205 may be fabricated from a copper alloy with or without a corrosion resistant coating.

In addition to conductive member 205, a nut 209 or similar device may be provided and rotatably disposed upon conductive member 205. Nut 209 is preferably tapped with corresponding threading to conductive member 205 and rotates in manner that provides an engagement sufficient to provide electrical connectivity between wires 901 and conductive member 205 and/or between wires 901 (see e.g., FIG. 9). For example, a wire 901 having a pig-tail or other conventional wire connector may be placed in contact with the conductive member 205 and nut 209 may be rotated to engage the wire connector in physical contact with the conductive member. The rotation of the nut 209 may be achieved by applying torque to the nut 209 by a wrench or similar device, wherein sufficient torque is provided to resist unintentional disengagement of the nut 209 from conductive member 205. The connector body 101 is fabricated from a material that is sufficiently rigid to resist torque and to provide resistance to pull out forces. That is, the resultant structure resists bending, flexing, deformation, breakage or damage as a result of the forces applied to the conductive member 205 and nut 209. In a preferred embodiment, the connector body 101 is sufficiently rigid to resist high torque, including high torque, including torque greater than about 240 lb-in. applied to the conductive members 205. Further, the connector body 101 is configured with dimensions and a geometry that provides resistance to torque applied to conductive member 205 and nut 209. Rotation of conductive member 205 with respect to connector body 101 within terminal insert 203 may further be inhibited, resistance to disengagement from connector body 101 and resistance to torque and pull out forces may be increased by application of adhesive, thread locking compound or similar compositions bonding the surface of the conductive member 205 to a surface of terminal insert 203. The connector body 101 is also resistant to pull out forces resulting from forces from relative movement of forces on wires or devices connected to conductive members 205. Pull out forces include any combination of forces, such as shear, tensile or compressive forces, applied in a manner that urges the conductive members 205 into disengagement from the power terminal 100. For example, in vehicle applications, pull out forces may result from shifting of attached equipment flexing of materials connected to or in proximity to the power terminal 100 and/or other forces, such as gravity. While not so limited, the combination of mounting bar 307, terminal insert 203 and connector body 101 preferably resists high pull out forces including, but not limited to, pull out forces of greater than about 1800 lbs per terminal insert 203. In certain embodiment of the present invention, the combination of mounting bar 307, terminal insert 203 and connector body 101 preferably resists high pull out forces including, but not limited to, pull out forces of greater than about 5200 lbs. for a three terminal insert 203 arrangement or 7200 lbs. for a four terminal insert 203 arrangement.

Figure 8:
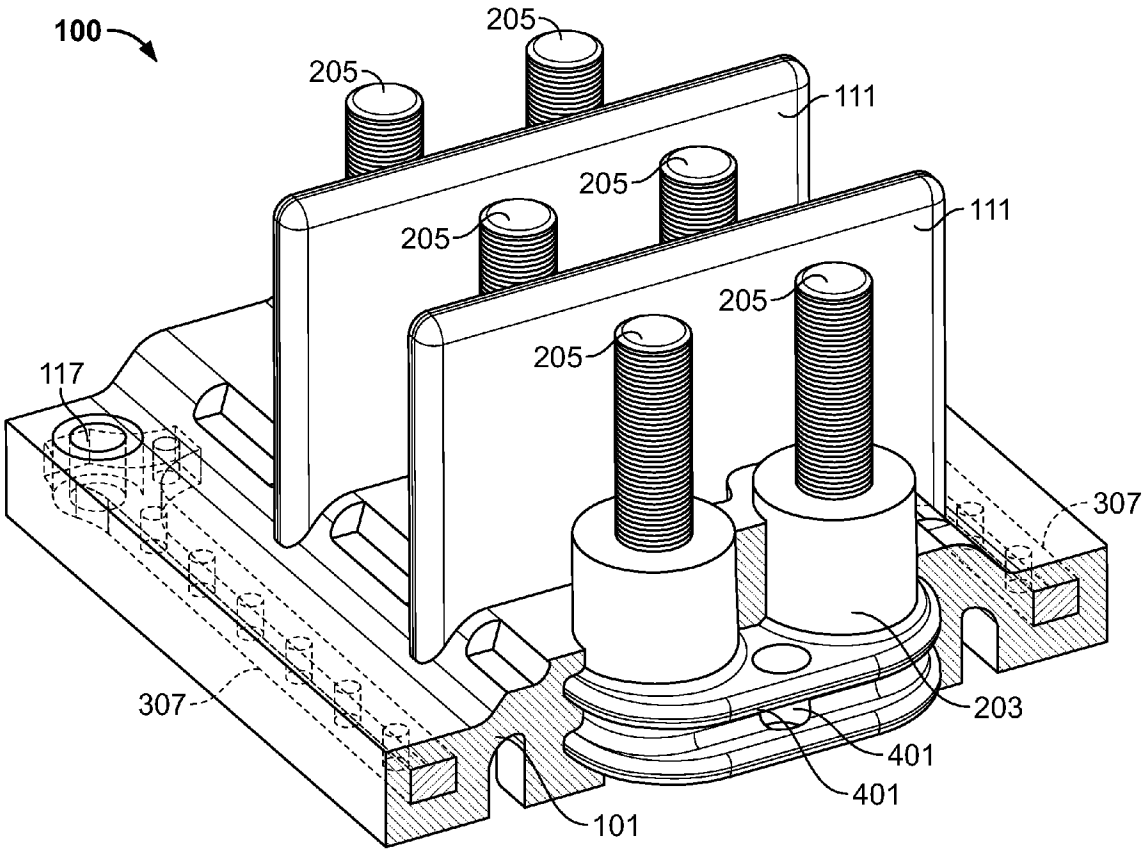
FIG. 8 shows a top perspective view including a cross-section taken along line 8-8 of FIG. 6 of a power terminal according to an embodiment of the present invention.

The power terminal 100 may further include an electrically conductive washer or similar device (not shown) may be provided to improve the electrical connectivity of the wire 901 to the conductive member 205 when nut 209 engages the wire 901 (see e.g., FIG. 8). In another embodiment of the present invention, a conductive device may be configured as a commoning washer that is configured to span two or more conductive members 205 and function as an electrical jumper between conductive members 205 in order to provide electrical connectivity between conductive members 205. In this embodiment the washer or other device may include any geometry that permits contact with two or more conductive members, including but not limited to, an oval geometry, a figure-eight geometry or a bar configured to contact and engage each of the desired conductive members 205.

In order to provide separation between conductive member 205 pairs or other groupings (see e.g., FIG. 2), dividers 111 may be disposed between conductive member 205 groupings. As shown in FIG. 2, the conductive members 205 may be grouped in pairs of conductive members 205 that may or may not be directly electrically connected. The dividers 111 are fabricated from an insulating material, such as, but not limited to a thermoplastic or other polymer. The dividers are preferably sufficiently rigid to provide resistance to breakage during rotation and engagement of nut 209 with conductive member 205.

FIG. 3 shows a top perspective view including a cross-section taken along line 3-3 of FIG. 2 of a power terminal according to an embodiment of the present invention. As shown in the cross-section, conductive member 205 passes through opening 303 of terminal insert 203, wherein cap 301 is engaged in contact with terminal insert 203 (FIG. 2). The conductive member 205 passes through the terminal insert 203 and connector body 101 wherein nut 209 is permitted to threadingly engage the conductive member 205. Also shown in the cross-section, the cap 301 substantially prevents rotation of the conductive member 205 when engaged and in contact with the terminal insert 203. While the engagement shown includes contact between the cap 301 and the terminal insert 203, the engagement may be any engagement that substantially prevents rotation of the conductive member 205 and/or substantially prevents further advancement into the terminal insert 203. For example, termination of threading may be provided for engagement and substantially prevent rotation. Furthermore, material forming the connector body 101 is present in cap cavity 305 from the incorporation of the terminal insert 203, further providing resistance to rotation and torque. FIG. 3 also illustrates a mounting bar 307, which, like the terminal insert 203, is incorporated into the connector body 101 (see also FIG. 5). The mounting bar 307 is fabricated from a rigid material to provide strength to the connector body 101 and to provide resistance to bending, flexing, twisting or otherwise providing stress on the power terminal 100 from torque or other forces.

Figure 4:
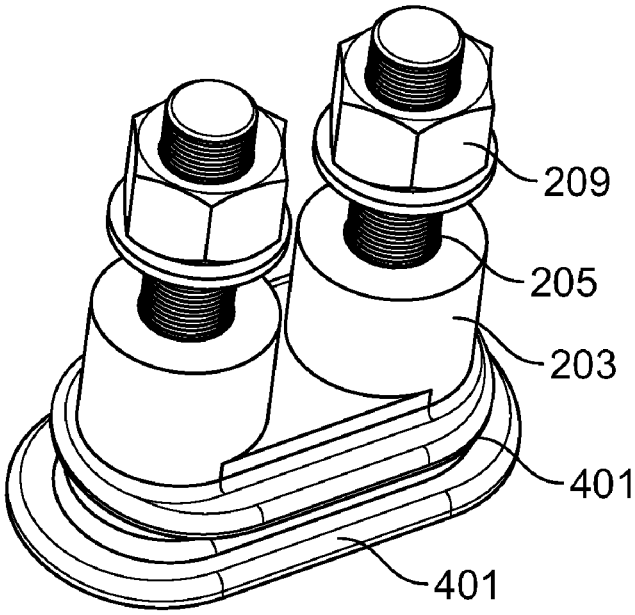
FIG. 4 shows a perspective view of a terminal insert according to an embodiment of the present invention.

FIG. 4 shows a top perspective view of a terminal insert 203 according to an embodiment of the present invention. As shown in FIG. 4, the terminal insert 203 is configured to receive conductive member 205. The conductive members 205 preferably threadingly engage the terminal insert 203 and provide a locked engagement that resists rotation when torque is applied to nuts 209 and conductive members 205 (e.g., further rotation of the threaded conductive member 205 is prevented due to the engagement of the conductive member 205 with the terminal insert 203). The terminal insert 203 is preferably a rigid material formable into a component sufficiently strong to resist torque provided on the conductive member 205 and nut 209. For example, the terminal insert 203 may comprise a metallic material, such as, but not limited to, aluminum, aluminum alloys, nickel, nickel alloys, nickel plating, stainless steel, magnesium, or magnesium alloys that has been cast, injection molded, and/or machined into a geometry suitable for incorporation into the connector body 101. The geometry of terminal insert 203 may be any geometry that provides resistance to rotation during exposure to torque. For example, the terminal insert 203 is preferably fabricated into an oval, elliptical or other non-circular geometry that increases the required force to cause rotation of the terminal insert 203 and/or the conductive member 205 during application of torque on the nut 209 and conductive member 205. Further the terminal insert 203 may include features 401, such as lips, ledges, surfaces, cavities or other surface features that provide additional retention of the terminal insert 203 within the connector body 101.

Figure 5:
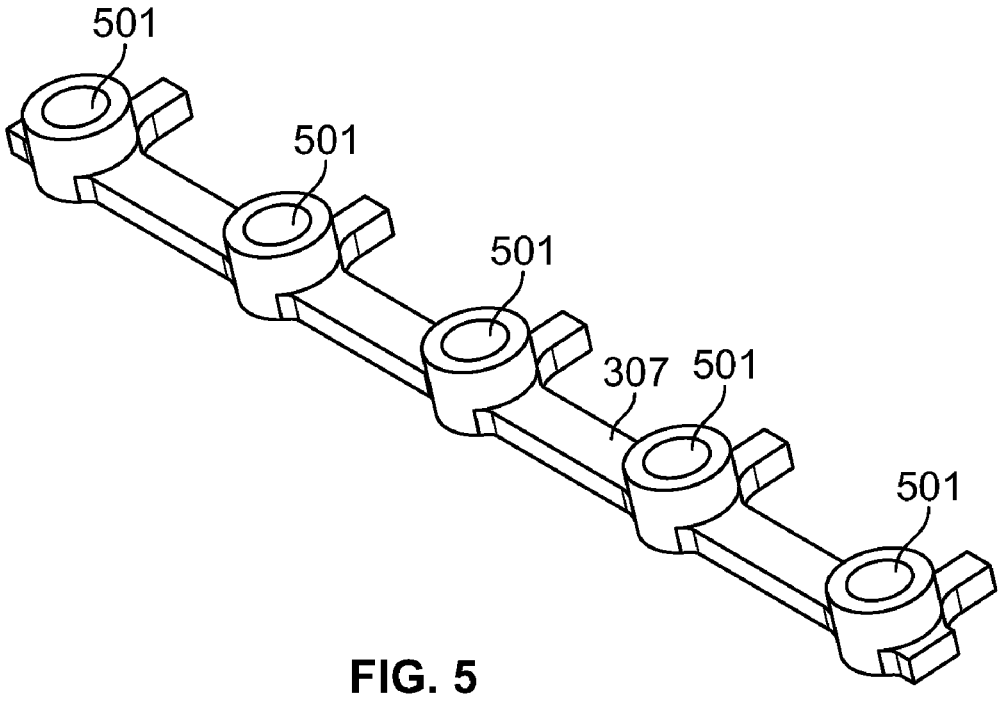
FIG. 5 shows a perspective view of a mounting bar according to an embodiment of the present invention.

FIG. 5 shows a perspective view of mounting bar 307 for incorporating into the connector body 307. The terminal bar 307 includes openings 501 configured to receive fasteners or similar devices for mounting the power terminal 100. The arrangement of openings 501 is not particularly limited and may include any number of configuration of openings that provides rigidity to the power terminal 100 and resists bending, flexing, twisting or stress on the power terminal 100 from torque or other forces. The terminal bar 307 may be formed utilizing any suitable technique, including machining, casting, or any other known fabrication technique. The mounting bar 307 is preferably a rigid material formable into a component sufficiently strong to resist torque and pull out forces provided on connector body 101 via the conductive member 205 and nut 209. While not so limited, the combination of mounting bar 307, terminal insert 203 and connector body 101 preferably resists high pull out forces including, but not limited to, pull out forces of greater than about 1800 lbs per terminal insert 203. The mounting bar 307 may comprise a metallic material, such as, but not limited to, aluminum, aluminum alloys, nickel, nickel alloys, nickel plating, stainless steel, that has been cast and/or machined into a geometry suitable for incorporation into the connector body 101.

Figure 6:
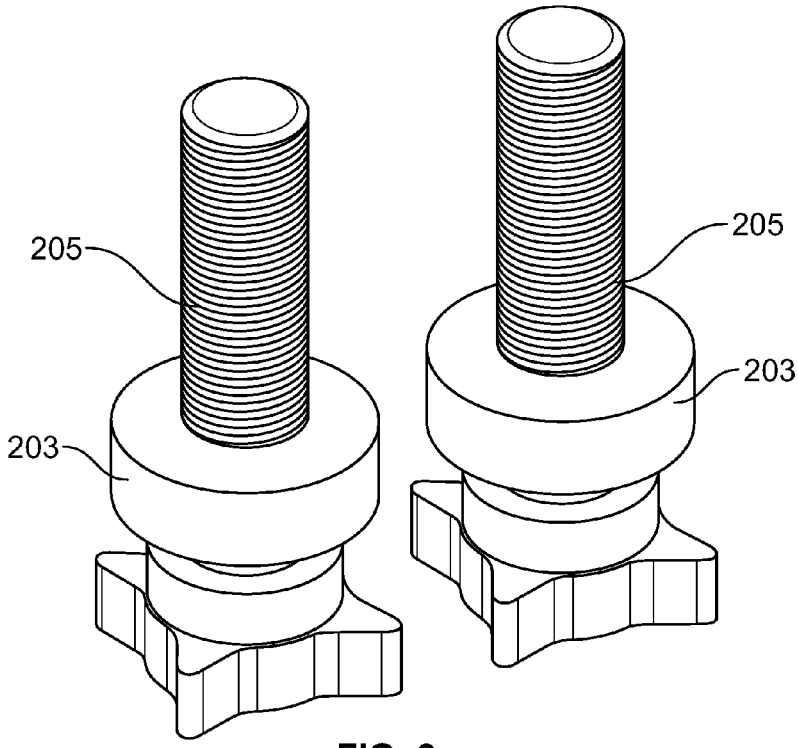
FIG. 6 shows a perspective view of a terminal insert according to another embodiment of the present invention.

FIG. 6 shows an alternate embodiment of the present invention, the terminal insert 203 and the conductive member 205 are of unitary construction. In this embodiment of the present invention, the conductive member 205 and cap 301 may be fabricated with sufficient surface area to resist rotation in response to torque applied to nut 209. Suitable geometries for this embodiment include a cross or "plus-sign shaped" geometry or other geometry having features 401 preferably transverse to the threaded portion of the conductive member 205. This embodiment may include any number of conductive members 205 and may permit interlocking geometries for cap 301 or unitary components having multiple terminals formed from conductive members 205. The incorporation of the terminal insert 203 into the conductive member 205 allows a reduced amount of material, reducing the weight of the power terminal 100.

Figure 7:
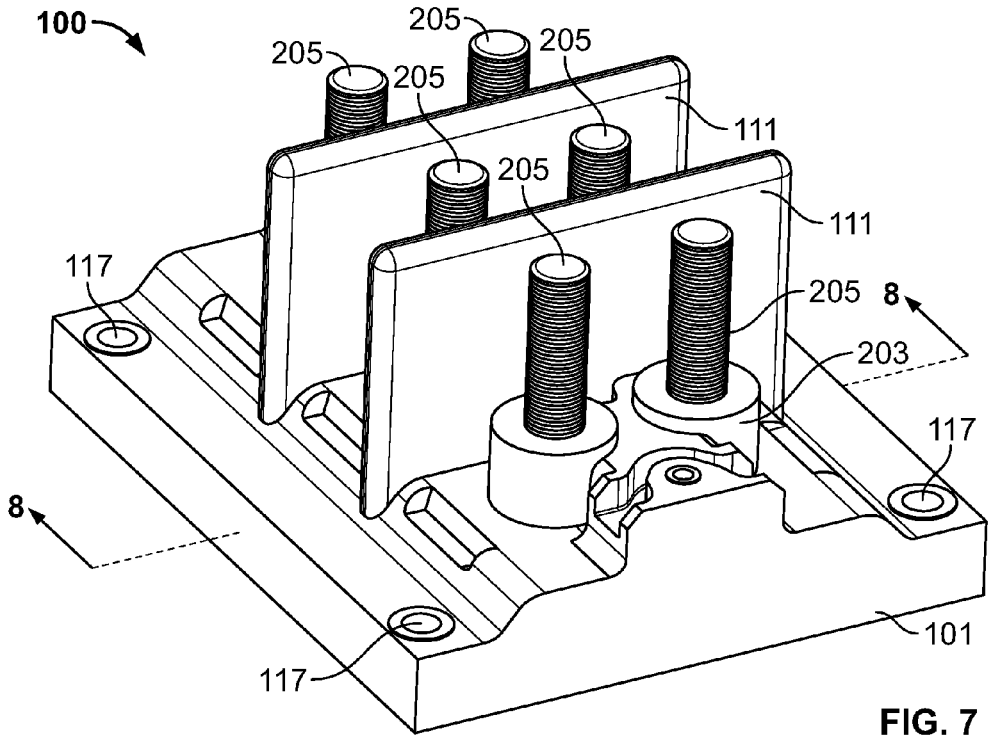
FIG. 7 illustrates a power terminal according to another embodiment of the present invention with the cover removed.

FIG. 7 shows an alternate embodiment of the present invention, with six conductive members 205 (i.e., terminals). The arrangement shown in FIG. 7 includes the structure of FIGS. 1-3, including the arrangement of connector body 101, conductive member 205, terminal insert 203, divider 111 and mounting openings 117. The arrangement shown in FIG. 7 is more compact and weighs less than the eight conductive members 205 arrangement of FIGS. 1-3. The embodiment of FIG. 7 includes conductive members 205 pairs separated by dividers 111.

FIG. 8 shows a top perspective view including a cross-section taken along line 8-8 of FIG. 7 of a power terminal according to an embodiment of the present invention. As shown in FIG. 8, the terminal insert is a unitary construction prior to incorporation into the connector body 101 that may receive conductive members 205 to provide conductive surfaces onto which wires 901 or other devices may be engaged. The terminal insert 203 includes features 401 that, when incorporated into the connector body 101, provides retention of the terminal insert 203 in the power terminal 100.

Figure 9:
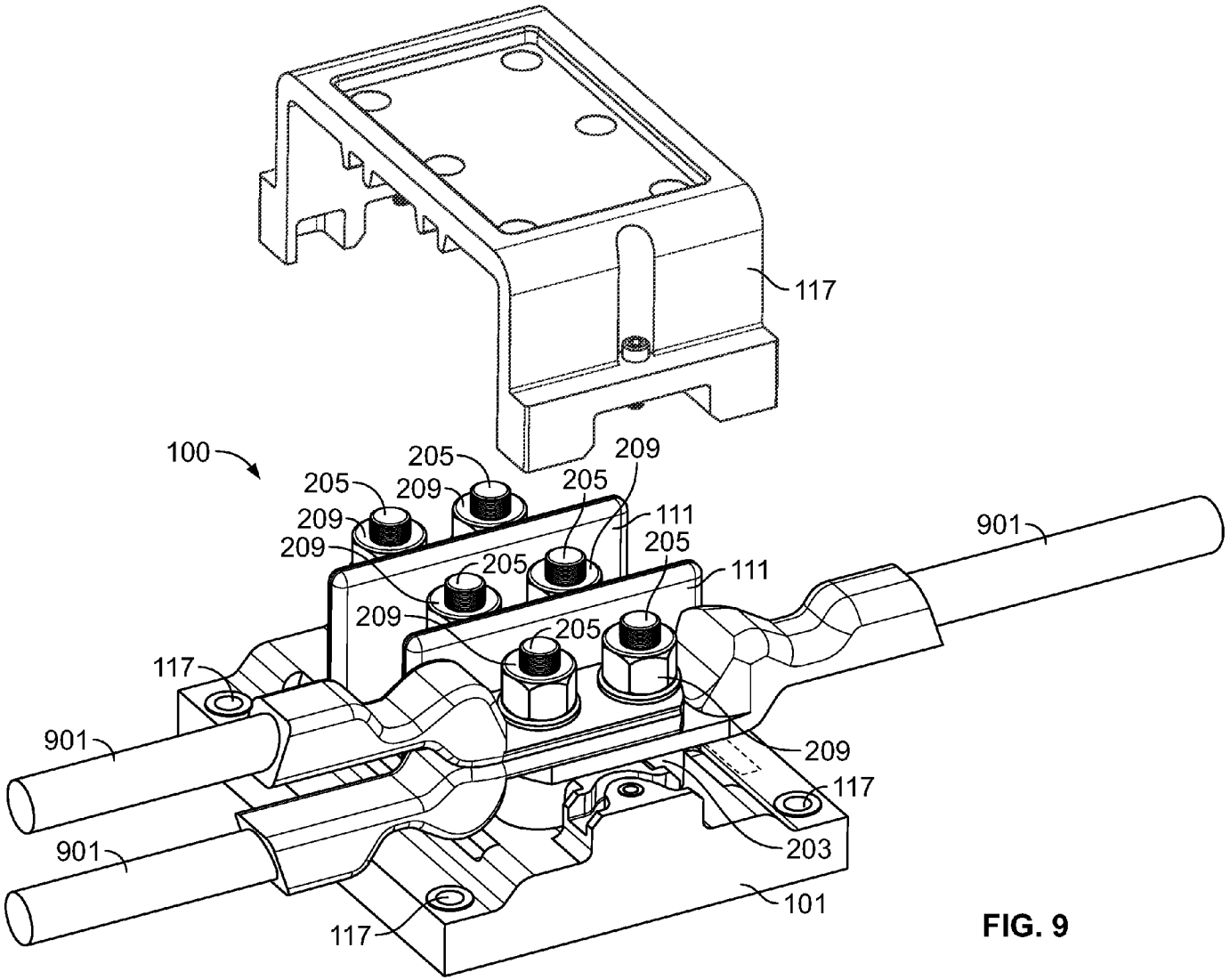
FIG. 9 illustrates an exploded view of a power terminal 100 according to another embodiment of the present invention having wires engaged thereto.

FIG. 9 shows a partially exploded view of power terminal 100 having wires 901 engaged thereto. As shown in FIG. 9, the wire is disposed on conductive member 205 between nut 209 and the terminal insert 203 providing electrical connectivity between wire 901 and the conductive member 205 when nut 209 engages the wire 901. While the embodiment shown in FIG. 8 includes wires 901 that span two conductive members 205, the invention is not so limited and may include commoning washers or similar devices that span multiple conductive members 205 in order to provide electrical connectivity. Likewise, the wires 901 in contact with the power terminal 100 may be any wire configuration or geometry engagable with the conductive member 205. Further, the wires 901 may engage a single conductive member 205 or a plurality of conductive members 205.

While the above power terminal 100 has been shown and described with respect to an eight terminal (i.e., eight conductive members 205) and six terminal (i.e. six conductive members 205) arrangement, the power terminal 100 may be arranged in any suitable manner with any number of conductive member 205 that provides the connectivity of wires or electrical devices. In addition, although the power terminal 100 shown and described includes conductive member 205 pairs, any grouping of conductive members 205, including single conductive members, may be provided and may be separated utilizing dividers 111 or may be disposed and/or spaced in groups of conductive members 205 without utilizing dividers 111.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A power terminal comprising:

an electrically insulated connector body;

a terminal insert incorporated into the connector body and having at least one threaded electrically conductive member engaged with the terminal insert, the conductive member also having a cap portion incorporated into the connector body; and wherein the terminal insert is formed from a substantially rigid material and is configured to resist torque and pull out forces applied to the conductive member.

2. The power terminal of claim 1, wherein the terminal insert comprises a metallic material.

3. The power terminal of claim 1, wherein the cap portion has a hexagonal geometry.

4. The power terminal of claim 1, wherein the cap portion includes a cavity configured to receive a portion of material making up the connector body.

5. The power terminal of claim 1, further comprising a mounting bar incorporated into the connector body.

6. The power terminal of claim 1, wherein the mounting bar is formed from a rigid material and is configured to provide rigidity to the connector body.

7. The power terminal of claim 1, further comprising a commoning washer disposed on the conductive member.

8. The power terminal of claim 1, further comprising a cover detachably engaged with the connector body.

9. The power terminal of claim 1, wherein the conductive member further includes a nut threadingly engaged with the conductive member.

10. The power terminal of claim 1, wherein one or both of the terminal insert and the conductive member comprises a corrosion resistant coating.

11. The power terminal of claim 1, wherein the connector body further comprises electrically insulative dividers engaged with the connector body and disposed to arrange groups of electrically conductive members.

12. The power terminal of claim 1, wherein the terminal insert and conductive member are of unitary construction.

13. The power terminal of claim 12, wherein the cap portion has a cross-shaped geometry.

14. A method for forming a power terminal comprising:

providing a substantially rigid terminal insert having a threaded conductive member engaged thereto;

incorporating the terminal insert and a cap portion of the threaded conductive member into a connector body;

wherein the terminal insert is configured to resist torque and pull out forces applied to the conductive member.

15. The method of claim 14, wherein the cap portion has a hexagonal geometry.

16. The method of claim 14, further comprising incorporating a mounting bar into the connector body to provide rigidity to the connector body.

17. The method of claim 14, further comprising rotatably mounting a nut onto a conductive member.

18. The method of claim 14, further comprising applying a corrosion resistant coating on one or both of the terminal insert and the conductive member.

19. The method of claim 14, wherein the providing includes providing a terminal insert and conductive member of unitary construction.

20. The method of claim 19 wherein the cap portion has a cross shaped geometry.

* * * * *